US005573421A

United States Patent [19]

Reichle

[11] Patent Number: 5,573,421

[45] Date of Patent: Nov. 12, 1996

[54] CONDUCTOR CONNECTING APPARATUS FOR WEAK-CURRENT SYSTEM

[75] Inventor: Hans Reichle, Wetzikon, Switzerland

[73] Assignee: Reichle + De-Massari AG, Wetzikon, Switzerland

[21] Appl. No.: 322,327

[22] Filed: Oct. 13, 1994

[30] Foreign Application Priority Data

Oct. 18, 1993 [CH] Switzerland ..... 03 140/93

[51] Int. Cl.[6] ..... H01R 4/24

[52] U.S. Cl. ..... 439/409; 439/417

[58] Field of Search ..... 439/391, 395–401, 439/409–410, 417

[56] References Cited

U.S. PATENT DOCUMENTS

| | | | |
|---|---|---|---|
| 3,835,445 | 9/1974 | Hardesty | 439/410 |
| 4,039,239 | 8/1977 | Cobaugh et al. . | |
| 4,413,872 | 11/1983 | Rudy, Jr. et al. | 439/410 |
| 4,426,125 | 1/1984 | Crawford | 439/409 |
| 4,455,058 | 6/1984 | Harner et al. | 439/409 |
| 4,461,528 | 7/1984 | Dorand et al. | 439/409 |
| 4,793,823 | 12/1988 | Cozzens et al. | 439/409 |
| 4,968,267 | 11/1990 | Payne | 439/410 |
| 5,106,323 | 4/1992 | Gerhard | 439/410 |
| 5,195,907 | 3/1993 | Urban | 439/410 |

FOREIGN PATENT DOCUMENTS

| | | | |
|---|---|---|---|
| 463577 | 8/1946 | Belgium . | |
| 0 531 677 | 3/1993 | European Pat. Off. . | |
| 29 12 882 | 10/1980 | Germany . | |
| 67298 | 9/1950 | Netherlands . | |
| 1454936 | 11/1976 | United Kingdom . | |
| 2034537 | 6/1980 | United Kingdom | 439/391 |

*Primary Examiner*—David L. Pirlot
*Assistant Examiner*—Jill DeMello
*Attorney, Agent, or Firm*—Spencer & Frank

[57] ABSTRACT

The conductor connecting apparatus for weak-current systems with means for solderless wiring comprises a casing part with at least one longitudinal duct for receiving a conductor. Every longitudinal duct cooperates in its axial direction with a contact zone of a contact pin extending tangentially to the inserted conductor as well as with at least one clamping pin also extending tangentially to the inserted conductor. The contact zone of the contact pin as well as the clamping pin project into duct in such a way that when the longitudinal conductor is inserted, a predefined contact pressure is produceable on its stripped zone.

6 Claims, 3 Drawing Sheets

CONDUCTOR CONNECTING APPARATUS FOR WEAK-CURRENT SYSTEM

BACKGROUND OF THE INVENTION

The present invention relates to a conductor connecting apparatus for weak-current systems, with means for solderless wiring, which comprise on one casing part at least one longitudinal duct for receiving a conductor of a data cable or the like.

Solderless wiring is gaining considerably in importance in all fields of weak-current engineering. In this connection a plug is known, in particular a jumpering plug, with a cutting-clamping connection which allows fixing the wire in a solderless manner to the connection, in that said wire including its insulation is pressed into a groove, with the edges of the groove cutting through the insulation and slightly penetrating the conductive material whilst producing an electric contact.

This solderless cutting-clamping wiring also suggests itself to modular connectors for telephone or weak-current systems, in which for the wire distance or contact pin distance standardized or quasi-standardized rasters have come about, whereby a longitudinal wire insertion slot is provided for each wire or lead which is penetrated at one position by a transversal clamping blade of the contact pins usually projecting downwards from the insertion slot.

Accordingly, the EP-patent 531'677 of the same applicant already relates to a plug with a block-like connection unit preferably with a plurality of equal sided, parallel ducts for receiving an insulated wire lead or core lead, into each of which ducts open out a first lateral breakthrough for receiving a clamping part as well as a second breakthrough for receiving a clamping blade of cutting-plugging connections for solderless wiring, with the half shells of the casing carrying the means for the solderless wiring being joinable with the connection unit.

Problematic in such known conductor connecting apparatuses is the unavoidably high dissolution of the twisting of the conductor of a cable, which has a particularly negative effect in data cables.

SUMMARY OF THE INVENTION

It is therefore the object of the present invention to provide a conductor connecting apparatus which in a symmetrical arrangement requires the smallest possible dissolution of the twisting of the conductors of a cable and in addition the adherence to the smallest possible raster, such as the print raster in data transmission technology.

This is achieved in accordance with the invention that every lonqitudinal duct cooperates in its axial direction with a contact area of a contact pin extending tangentially to the inserted conductor as well as with at least one clamping pin or cam also extending tangentially to the inserted conductor, whereby the contact zone of the contact pin as well as the clamping pin or cam project into the longitudinal duct in such a way that when a conductor is inserted, a predefined contact pressure is produceable on its stripped zone.

In this respect it is of advantage that the contact-sided centric distance of the contact zone is smaller than the radius of the stripped conductor and the support-sided centric distance of the clamping pin or cam is smaller or equivalent to the radius of the stripped conductor.

In this respect the embodiment may be such that the longitudinal duct extends as a bore in a block-shaped wire casing which is penetrated tangentially in its axial direction on either side by transversal bores for receiving at least one contact blade of a contact pin or for receiving at least one clamping pin on a clamping plate or that parallel groove-shaped longitudinal ducts with clamping cams moulded thereon and contact pins arranged thereon extend to a casing part which carries a swivelling lid used for pressing the conductor in.

As a consequence of these measures it is now possible to contact the conductors or wires directly next to one another and without having to spread them apart, which ensures, among other things, ideal prerequisites for high transmission frequencies.

An opposing arrangement of contact blade and clamping pin or cam on either side of the conductor would be sufficient for achieving an effective contacting and simultaneous securing of the wires against longitudinal displacement.

In order to bring about the latter also in case of tolerances in the conductors, it is preferable within the scope of the invention when the contact blade is disposed with a gap between two opposed clamping pins or cams, which forces the conductor into a wave-like course in its extension.

Here, the clamping pins or cams may be opposed in a symmetrical manner.

It may also be of advantage when the clamping pins or cams and the associated contact pins or contact blades are arranged in the longitudinal direction of the conductor with a gap or successively behind one another so as to contact each of the conductors sitting close to one another.

Furthermore, there are preferable embodiments in that the contact pins and the clamping pins are pressed into the wire casing from opposite sides or from the same side.

BRIEF DESCRIPTION OF THE DRAWING

Exemplary embodiments of the subject matter of the invention are explained in closer detail below by reference to the enclosed drawings, in which.

DETAILED DESCRIPTION OF THE PREFERRED EMBODIMENTS

Figure 1:
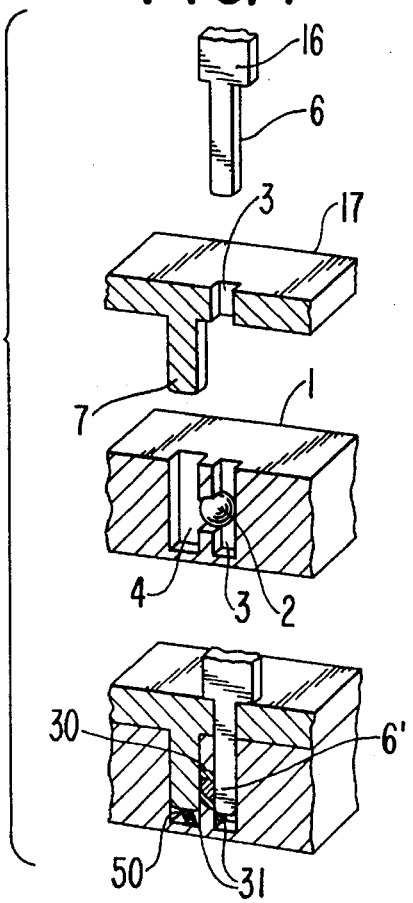
FIG. 1 shows an exploded view of a simplified principal arrangement of the conductor connecting apparatus.

The conductor connecting apparatus referred to herein comprises, as can be seen in the Figures, a casing part 1; 1', at least one longitudinal duct 2;2' for receiving a conductor 30 of a data cable 40 or the like.

For solderless wiring it is important with respect to the invention that every longitudinal duct 2;2' cooperates in its axial direction with a contact zone 6 of a contact pin 16 extending tangentially to the inserted conductor as well as with clamping pin 7 or cam 7' also extending tangentially to the inserted conductor, whereby the contact zones 6 of the contact pin 16 as well as of the clamping pin 7 or cam 7' project into the longitudinal duct 2;2' in such a way that a predefined contact pressure can be produced on the stripped zone of the inserted conductor 30, as is shown in particular in FIGS. 1, 3 and 5 to 8.

Figure 6:
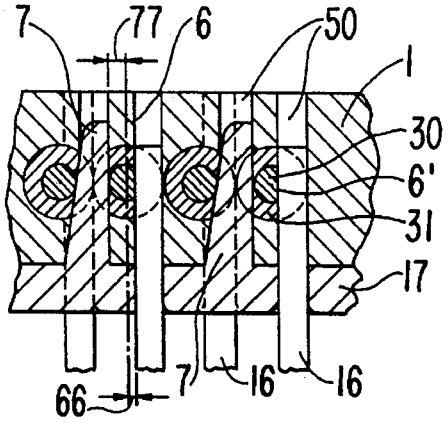

There, the arrangement is such that the contact-sided centric distance 66 of the contact zone 6 is smaller than the radius of the stripped conductor and the support-sided centric distance 77 of clamping pin 7 or cam 7' is smaller than or equal to the radius of the stripped conductor, as is indicated in FIG. 6.

Figure 2:
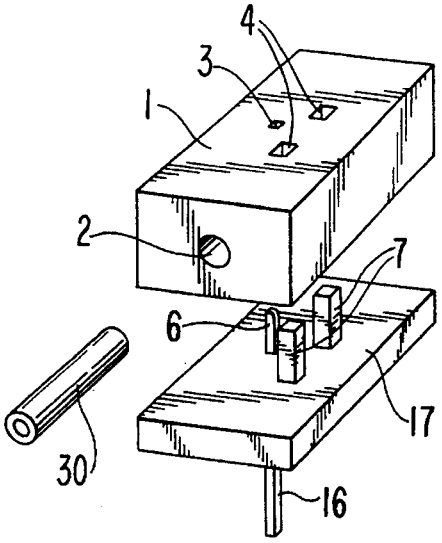
FIG. 2 shows an embodiment of the arrangement in accordance with FIG. 1 in a diagrammatical view.

In a first embodiment the conductor connecting apparatus in accordance with FIGS. 1 and 2 for data cables, in particular, preferably on printing rasters comprises principally a block-shaped wire casing 1 with at least one longitudinal duct 2 for receiving a conductor 30 of a data cable 40 (FIG. 4) or the like, which longitudinal duct 2 is penetrated tangentially in its axial direction on either side by transversal bores 3,4 for receiving at least one contact blade 6 of a contact pin 16 or for receiving at least one clamping pin 7 on a clamping plate 17.

As is clearly shown in FIG. 1, the pressing in of the clamping pin 7 into the transversal bore 4 causes the insulation 31 to be pressed away from conductor 30 and a fixing of the stripped conductor. Furthermore, the pressing in of the clamping blade 6 into transversal bore 3 also causes a part of the insulation 31 to be pressed away from conductor 30 and, at the same time, clamping blade 6 notches itself into the stripped conductor at position 6', which leads to optimal contacting.

The insulation parts pressed away may then rest in a lower zone 50 of the transversal bores 3 and 4.

Generally speaking, an opposed arrangement of contact blade 6 and clamping pin 7 on either side of the conductor 30 would be sufficient so as to achieve an effective contacting and simultaneous securing of the wires against longitudinal displacement.

Figure 3:
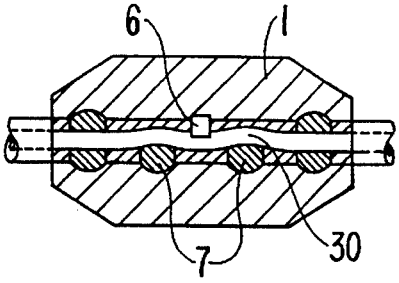
FIG. 3 shows a partial sectional view of the arrangement in accordance with FIG. 2.
Figure 7:
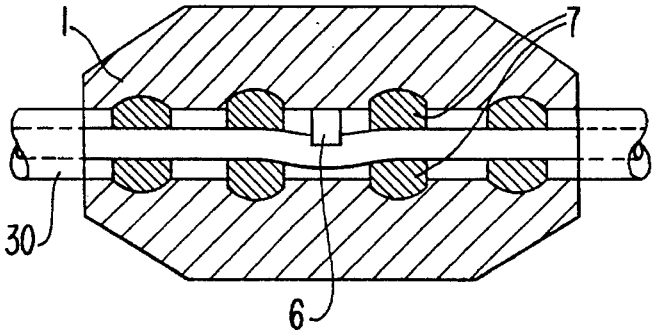
FIG. 7 shows a partial sectional view of an embodiment of the arrangement in accordance with FIG. 3 and FIGS. 8 and 9 show a diagrammatical view of a further embodiment of the conductor connecting apparatus in accordance with the invention.

In order to achieve the latter in an optimal manner also in tolerances in the conductors, it is preferable when according to FIGS. 2 and 3 the contact blade 6 is disposed with a gap between the two opposed clamping pins 7, which forces conductor 30 into a wave-like course in its extension, or clamping pins 7 may be opposed symmetrically as shown in FIG. 7.

The conductor connecting apparatus in accordance with the invention may now be used in various manners.

Figure 4:
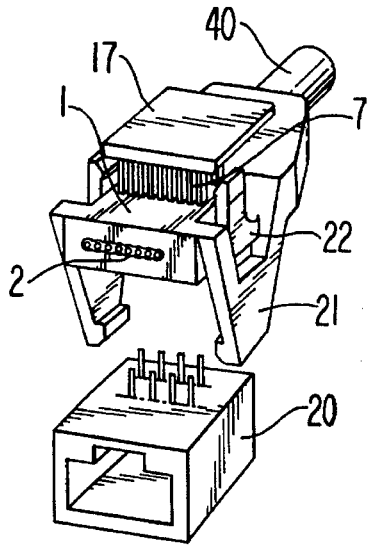
FIG. 4 shows a diagrammatical view of an embodiment of the conductor connecting apparatus in accordance with the invention.

In accordance with FIG. 4, a wire casing 1 with a larger number of longitudinal ducts 2 is provided for receiving a respective number of closely adjacent parallel conductors of a data cable 40 which are fixed by means of clamping pins 7 to clamping plate 17. The entirety of the arrangement is pressed onto contact pins 6,16 of a contact plug 20 or the like, so that a contacting in accordance with the above takes place.

Catch means 21 and 22 ensure a rigid connection between wire casing 1, clamping plate 17 and contact plug 20.

Obviously, the clamping pins 7 and the associated contact pins 16 or contact blades 6 are arranged in the longitudinal extension of conductor 30 with a gap or successively so as to contact every one of the closely adiacent conductors.

Figure 5:
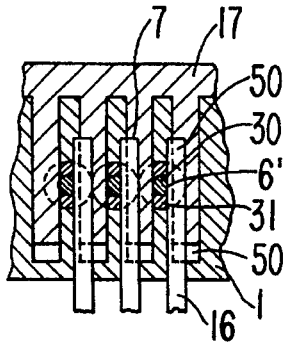
FIGS. 5 and 6 show sectional views of embodiments of the conductor connecting apparatus in accordance with the invention.

As is shown in FIGS. 5 and 6, the contact pins 6,16 and the clamping pins 7 may be pressed in from opposite sides (FIG. 5) or from the same side (FIG. 6) into the wire casing 1.

It is understood that within the scope of the invention a large number of embodiments is possible without deviating from the inventive idea.

Furthermore, the clamping pins 7 may be provided with any random cross section in addition to the rectangular form shown herein.

In addition, a contacting with downwardly projecting solder or plug contact pins can be made simultaneously from both sides of the wire casing.

Furthermore, the contact pins or their blades may be curved, conical or resilient so as to obtain a pretension.

Moreover, wedge-like contact pins 16 in accordance with FIG. 6 allow an adaptation to different wire diameters.

Figure 8:
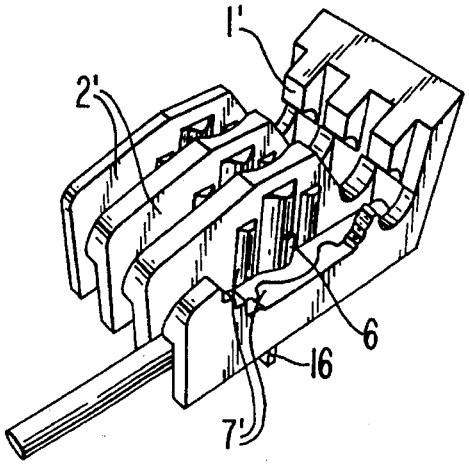
Figure 9:
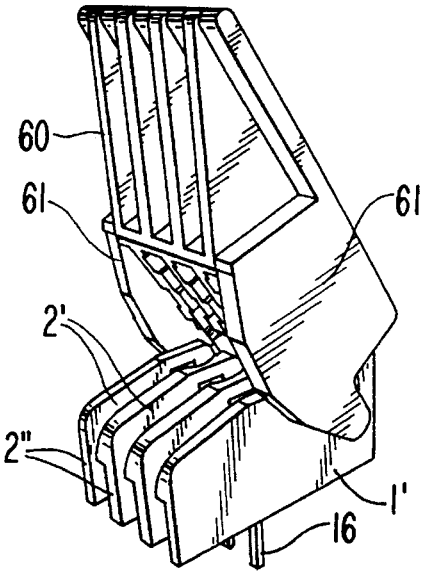

In a further embodiment it is possible in accordance with FIGS. 8 and 9 that parallel groove-like longitudinal ducts 2' with clamping cams 7' formed thereon and contact pins 16 arranged thereon extend on a casing part 1' which is provided with a swivelling lid 60 for pressing in the conductor 30. In order to counteract the displacement forces acting laterally on bridges 2" during the pressing in of the conductor, swivelling lid 60 is provided in particular with lateral flanges 61 which overlap the side walls of the casing part 1' practically free from play and thus prevent their outward displacement.

Here, instead of the swivelling lid the wire may be pressed in by means of a tool (not shown) or a pressing lid which can be pressed down vertically (not shown).

The arrangement of the contact pins 16 and the clamping pins or clamping cams 7 here relative to the conductor containing longitudinal duct 2 or 2' can be varied, as described above.

While there are shown and described preferred embodiments of the invention, it is to be distinctly understood that the invention is not limited thereto but may be embodied and practised within the scope of the following claims. ACCORDINGLY;

What I claim is:

1. A conductor connecting apparatus comprising:

a casing part including a casing portion and defining a plurality of parallel groove-like longitudinal ducts disposed in the casing portion, each of the longitudinal ducts having a duct longitudinal axis and being configured to receive a conductor of a cable, each conductor having a conductor longitudinal axis adapted to extend parallel to the duct longitudinal axis of a corresponding longitudinal duct when the conductor is received within the corresponding longitudinal duct; and contacting means adapted to contact each conductor by projecting into a corresponding longitudinal duct and extending in a direction having a component transverse to the conductor longitudinal axis, the contacting means including:

a plurality of contact pins disposed in the longitudinal ducts, each of the contact pins including a contact blade having a contact surface for contacting a corresponding conductor at a corresponding contact surface thereof by stripping insulation from the conductor, a distance defined between the conductor longitudinal axis and the contact surface of the conductor being smaller than a radius of the conductor; and a clamping means including clamping cams formed on walls of the longitudinal ducts, each clamping cam comprising a clamping surface for contacting a corresponding conductor at a corresponding clamping surface thereof by stripping insulation from the conductor, a distance defined between the conductor longitudinal axis and the clamping surface of the conductor being smaller than or equal to the radius of the conductor, the clamping means being adapted to cooperate with the contact blade for effecting a predetermined contact pressure on the conductor, the casing part further including a lid adapted to be mated with the casing portion for pressing respective conductors into respective ones of the longitudinal ducts thereby effecting contact between the conductors and corresponding ones of the contact pins and the clamping cams.

2. The connecting apparatus according to claim 1, wherein the contact blade and at least some of the clamping cams are disposed oppositely with respect to one another on either side of each longitudinal duct for contacting the corresponding conductor.

3. The connecting apparatus according to claim 1, wherein two clamping cams are disposed on one side of each longitudinal duct for contacting the corresponding conductor, the contact blade being disposed between the two clamping cams on an opposite side of the longitudinal duct for contacting the conductor, the contact blade further being spaced from each of the two clamping cams for forcing the conductor in a wave-like course in a direction defined by the conductor longitudinal axis.

4. The connecting apparatus according to claim 1, wherein:

the casing portion of the casing part includes outer lateral side walls; and the lid includes lateral flanges thereon having inner lateral side walls, the lateral flanges being adapted to matingly receive the casing portion therebetween such that the outer lateral side walls of the casing part and the inner lateral side walls of the lid substantially border upon one another at overlapping regions thereof.

5. A conductor connecting apparatus comprising:

a casing part defining a plurality of parallel longitudinal ducts extending adjacent one another, each of the longitudinal ducts having a duct longitudinal axis and being configured to receive a conductor of a cable, each conductor having a conductor longitudinal axis adapted to extend parallel to the duct longitudinal axis of a corresponding longitudinal duct when the conductor is received within the corresponding longitudinal duct; and contacting means adapted to contact each conductor by projecting into a corresponding longitudinal duct and extending in a direction having a component transverse to the conductor longitudinal axis, the contacting means including:

a plurality of contact pins defining at least two rows of contact pins spaced with respect to one another in a direction parallel to the conductor longitudinal axis, the two rows thereby allowing a contacting of all adjacently disposed conductors received within respective ones of the longitudinal ducts, each of the contact pins including a contact blade having a contact surface for contacting a corresponding conductor at a corresponding contact surface thereof by stripping insulation from the conductor, a distance defined between the conductor longitudinal axis and the contact surface of the conductor being smaller than a radius of the conductor; and a plurality of clamping elements, configured differently with respect to the contact pins, defining at least two rows of clamping elements spaced with respect to one another in a direction parallel to the conductor longitudinal axis, the two rows thereby allowing a contacting of all adjacently disposed conductors received within respective ones of the longitudinal ducts, each of the clamping elements comprising a clamping surface for contacting a corresponding conductor at a corresponding clamping surface thereof by stripping insulation from the conductor, a distance defined between the conductor longitudinal axis and the clamping surface of the conductor being smaller than or equal to the radius of the conductor, the clamping means further being adapted to cooperate with the contact blade for effecting a predetermined contact pressure on the conductor.

6. The connecting apparatus according to claim 5, wherein the contact blade and the clamping means are adapted to be received within the casing part for contacting the conductor from opposite sides of the casing part.

* * * * *